US007020415B2

(12) United States Patent
Abe

(10) Patent No.: US 7,020,415 B2
(45) Date of Patent: Mar. 28, 2006

(54) IMAGE FORMING APPARATUS WITH TRANSFER BELT

(75) Inventor: Nobumasa Abe, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/625,907

(22) Filed: Jul. 24, 2003

(65) Prior Publication Data

US 2004/0208670 A1 Oct. 21, 2004

(30) Foreign Application Priority Data

Jul. 26, 2002 (JP) ..... 2002-218118
Jul. 26, 2002 (JP) ..... 2002-218119

(51) Int. Cl.
*G03G 15/00* (2006.01)

(52) U.S. Cl. ..... 399/110; 399/49; 399/62; 399/121; 399/124; 399/125; 399/302

(58) Field of Classification Search ..... 399/110, 399/62, 121, 302, 49, 124, 125
See application file for complete search history.

(56) References Cited

U.S. PATENT DOCUMENTS 5,587,769 A 12/1996 Sawada et al.
6,219,508 B1 4/2001 Nagatomi et al.
6,343,198 B1 * 1/2002 Sato ..... 399/121
6,453,135 B1 * 9/2002 Sameshima et al. ..... 399/110
2001/0051059 A1 12/2001 Morikami et al.
2002/0085849 A1 * 7/2002 Endo ..... 399/49
2002/0090234 A1 * 7/2002 Kusaba et al. ..... 399/302
2003/0086732 A1 * 5/2003 Abe et al. ..... 399/299

FOREIGN PATENT DOCUMENTS

EP 1098228 A2 5/2001
JP 11-095520 A 4/1999
JP 2001142378 A * 5/2001
JP 2001-249522 A 9/2001

* cited by examiner

*Primary Examiner*—Arthur T. Grimley
*Assistant Examiner*—Peter Lee
(74) *Attorney, Agent, or Firm*—Sughrue Mion, PLLC

(57) ABSTRACT

An image forming apparatus containing image forming stations Y, M, C, K for respective colors arranged along a transfer belt, each image forming station including an image carrier, a charging means and a developing means disposed around the image carrier. The apparatus further having a housing body in which the image forming stations and the transfer belt are situated, a support frame for supporting a roller around which said transfer belt is laid with some tension, and an image density detecting means which is arranged to face the transfer belt, wherein the support frame is attached to the housing body which allows the support frame to be detachable relative to the housing body by a pivotal movement. The apparatus has a locking device for locking the support frame to the housing body, wherein the image density detecting device is disposed in proximity to the locking device, thereby preventing the deterioration of the detecting accuracy of the image density detecting device.

6 Claims, 13 Drawing Sheets

IMAGE FORMING APPARATUS WITH TRANSFER BELT

BACKGROUND OF THE INVENTION

The present invention relates to a tandem-type image forming apparatus comprising image forming stations for respective colors which are arranged along a transfer belt and each of which is composed of an image carrier, and a charging means and a developing means which are arranged around the image carrier. The image forming apparatus forms a color image by passing the transfer belt through the respective stations.

As an example of such tandem-type image forming apparatuses as mentioned above, Japanese Patent Unexamined Publication No. H11-95520 describes an image forming apparatus comprising a transfer belt (paper carrying belt) which is laid around plural rollers with some tension to extend obliquely, plural image forming stations which are arranged in the tensioning direction of the transfer belt, and plural laser scanning means which are arranged to be partially superposed on each other, thus achieving the reduction in size of the entire apparatus. Disclosed in the publication is a technology for utilizing a space obliquely below the tensioned transfer belt as a space for mounting a sheet reversing path for dual-side printing or a sheet cassette or a space for allowing the operation for removing a jammed recording medium if jam occurs.

In addition, Japanese Patent Unexamined Publication No. 2001-249522 describes an image forming apparatus comprising a transfer belt (intermediate transfer belt) which is horizontally laid around plural rollers with some tension, plural image forming stations which are arranged to face a lower tensioned surface of the transfer belt, and writing heads of array type which are arranged below the respective image forming stations. Disclosed in the publication is a technology of shortening a recording medium carrying path by the aforementioned arrangement, whereby the area to be required to open for removing a jammed recording medium if jam occurs can be reduced, thus achieving the reduction in entire size of the image forming apparatus.

The reduction in entire size of the image forming apparatus is achieved by arranging the transfer belt obliquely or by employing the writing heads of array type in the aforementioned conventional technology. However, the arrangement of electrical circuit for operating an image forming apparatus is an important issue for further reducing the size of the apparatus.

Particularly in an tandem-type image forming apparatus just like the conventional apparatus as mentioned above, high-voltage power supply substrates for charging means, developing means, transfer means, and the like, a power supply substrate for mechanically operating image forming process, and an interface substrate for separating image data from a host computer into data for respective colors and conducting image processing should be large in order to operate the plural image forming stations at once. Therefore, as these substrates are disposed on an upper or lower portion of a side face or a back face of the image forming apparatus body, the miniaturization of apparatus turns out to be impossible.

Further, the aforementioned conventional methods have problems as mentioned below on the maintenance of apparatus. In the method of Japanese Patent Unexamined Publication No. H11-95520, if jam of a recording medium occurs, it is required to detach the image forming stations in the axial direction of image carriers from the apparatus before removing a jammed recording medium. Accordingly, not only it is troublesome to remove the jammed recording medium, but also there is a possibility that surfaces of the image carriers and the transfer belt may be scratched, causing image defects. The transfer belt can be evacuated by pivotal movement before removing a jammed recording medium. In this case, however, a space where the transfer belt is evacuated is necessary. This also avoids the miniaturization of apparatus. Openings for allowing the image forming stations to be inserted or removed in the axial direction of the image carriers and for allowing the removal of a jammed recording medium are required to be formed in a frame for properly positioning and supporting the respective components, thus reducing the rigidity of the frame. This may deteriorate the quality of obtained image.

On the other hand, the method of Japanese Patent Unexamined Publication No. 2001-249522 has a problem that the apparatus having an opening for replacing the image forming stations and an opening for removing a jammed recording medium which are separately provided along different directions and it is difficult for users to know which opening has to be handled by an operator for maintenance. In addition, since the transfer belt must be detached from the image forming apparatus body before replacing the image forming stations, an operator should prepare a space for temporally placing the transfer belt around the image forming apparatus before the replacement of the image forming stations. Therefore, there are problems that it is troublesome to replace the image forming stations and that the transfer belt may be scratched when temporally placed.

To solve the aforementioned problems, the present applicant has proposed, as Japanese Patent Application No. 2002-209615 (also filed in the United States), an image forming apparatus which comprises image forming stations for respective colors arranged along a transfer belt, each image forming station including an image carrier, a charging means and a developing means disposed around the image carrier, and is characterized in that said transfer belt is arranged obliquely and by further comprising a housing body in which the image forming stations and the transfer belt are arranged, and a frame which is attached to the housing body such that the frame is pivotally movable, wherein the transfer belt is attached to the frame. Accordingly, it is possible to provide an image forming apparatus which is quite compact and is quite ease of maintenance.

In the image forming apparatus proposed in the aforementioned application, an image density detecting means is held, which adjusts the positions of toner images for respective colors on the transfer belt, detects the densities of the respective toner images, and compensates color registration errors of the respective images and the image densities. A holding portion for holding the image density detecting means is provided with a mechanism, composed of screws or levers, for adjusting the position of a sensor relative to the intermediate transfer belt.

However, the image forming apparatus proposed in the aforementioned application has such a structure that the transfer belt must be detached from the housing body every time the maintenance is required. Accordingly, there is a problem that the position of the image density detecting means may be shifted when the transfer belt is returned to its original position by pivotal movement, with the result that the distance between the image density detecting means and the transfer belt is changed, thus deteriorating the detecting accuracy.

It is an object of the present invention to provide an image forming apparatus which can solve the aforementioned conventional problems and which is detachable by pivotal movement relative to a housing body and can prevent the deterioration in detecting accuracy of the image density detecting means.

SUMMERY OF THE INVENTION

To achieve the aforementioned object, the image forming apparatus of the present invention is an image forming apparatus comprising image forming stations for respective colors arranged along a transfer belt, each said image forming station including an image carrier, a charging means and a developing means disposed around said image carrier, said image forming apparatus further comprising a housing body in which said image forming stations and said transfer belt are situated, a support frame for supporting rollers around which said transfer belt is laid with some tension, and an image density detecting means which is arranged to face said transfer belt, wherein said support frame is attached to the housing body such that the support frame is detachable relative to the housing body by means of pivotal movement, and is characterized by further having a locking means for locking said support frame to the housing body, wherein said image density detecting means is disposed in proximity to said locking means.

Further, the image forming apparatus of the present invention is an image forming apparatus comprising image forming stations for respective colors arranged along a transfer belt, each said image forming station including an image carrier, a charging means and a developing means disposed around said image carrier, said image forming apparatus further comprising a housing body in which said image forming stations and said transfer belt are situated, a support frame for supporting rollers around which said transfer belt is laid with some tension, and an image density detecting means which is arranged to face said transfer belt, and is characterized in that said support frame is attached to the housing body such that the support frame is detachable relative to the housing body by means of pivotal movement and said image density detecting means is disposed in proximity to one of said rollers which is the nearest to the pivot of said support frame.

DETAILED DESCRIPTION OF THE PREFERRED EMBODIMENTS

Figure 1:
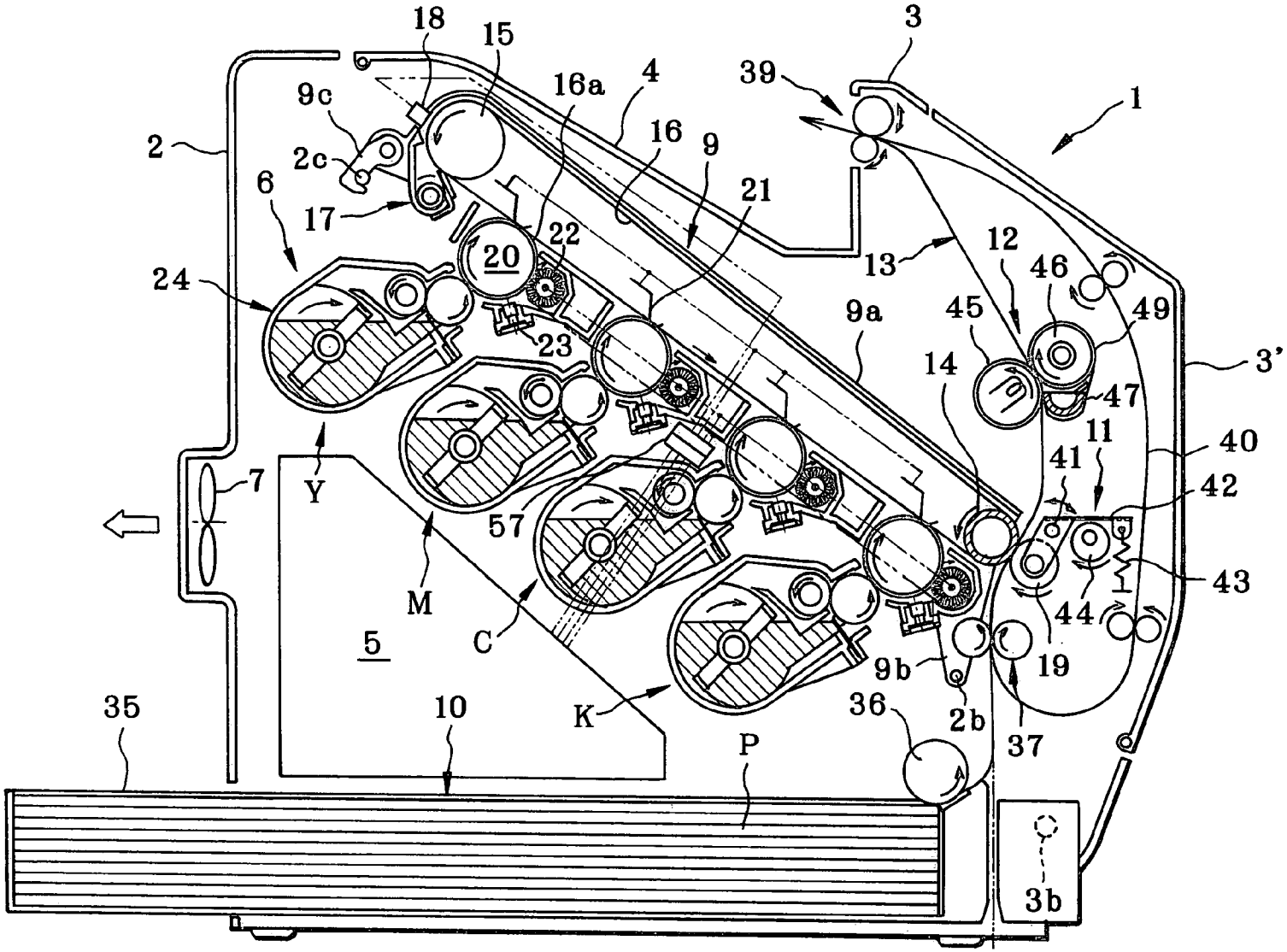
FIG. 1 is a schematic sectional view showing the entire structure of an embodiment of an image forming apparatus of the present invention.
Figure 2:
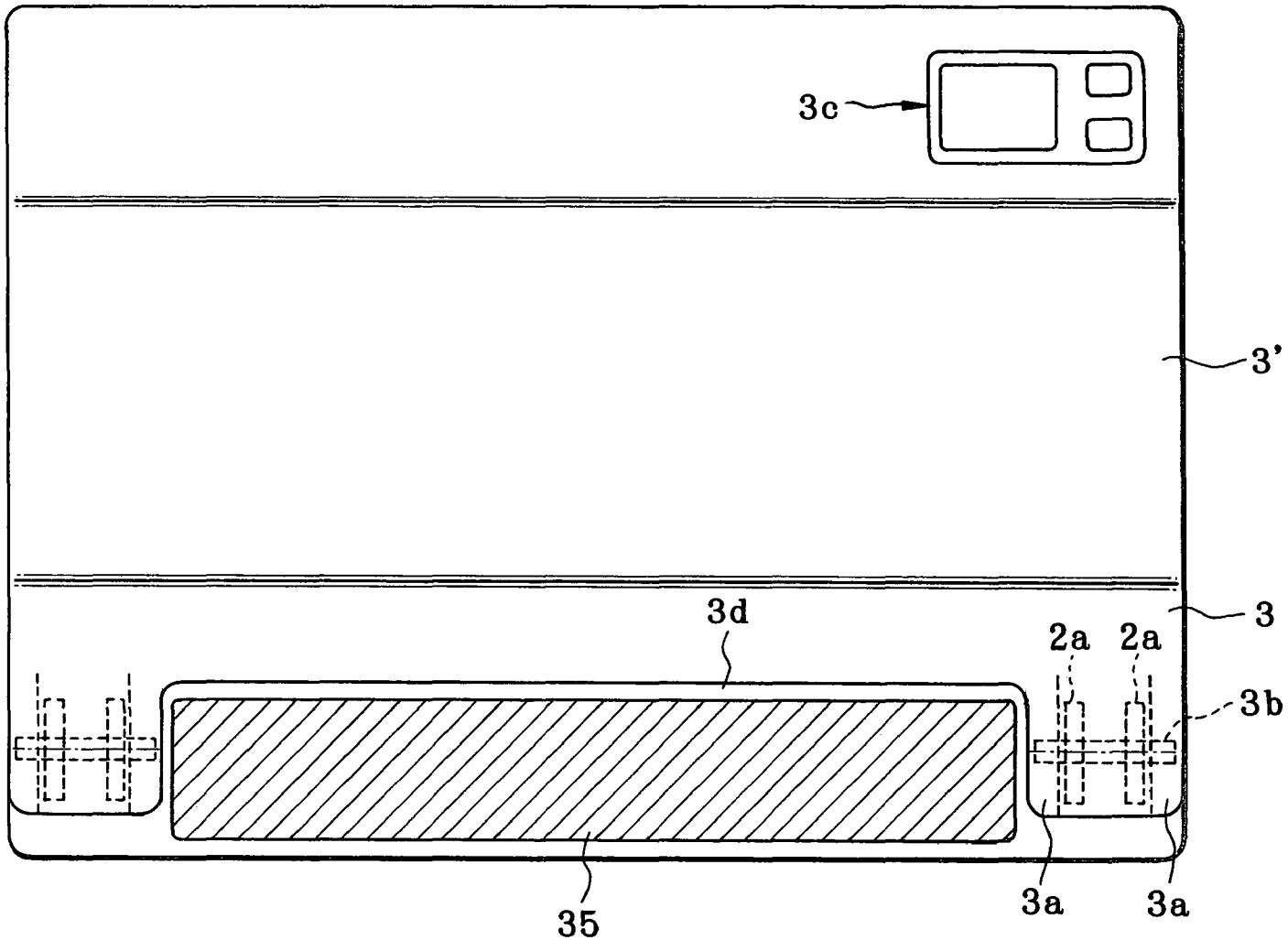
FIG. 2 is a front view taken from the right side of FIG. 1.
Figure 3:
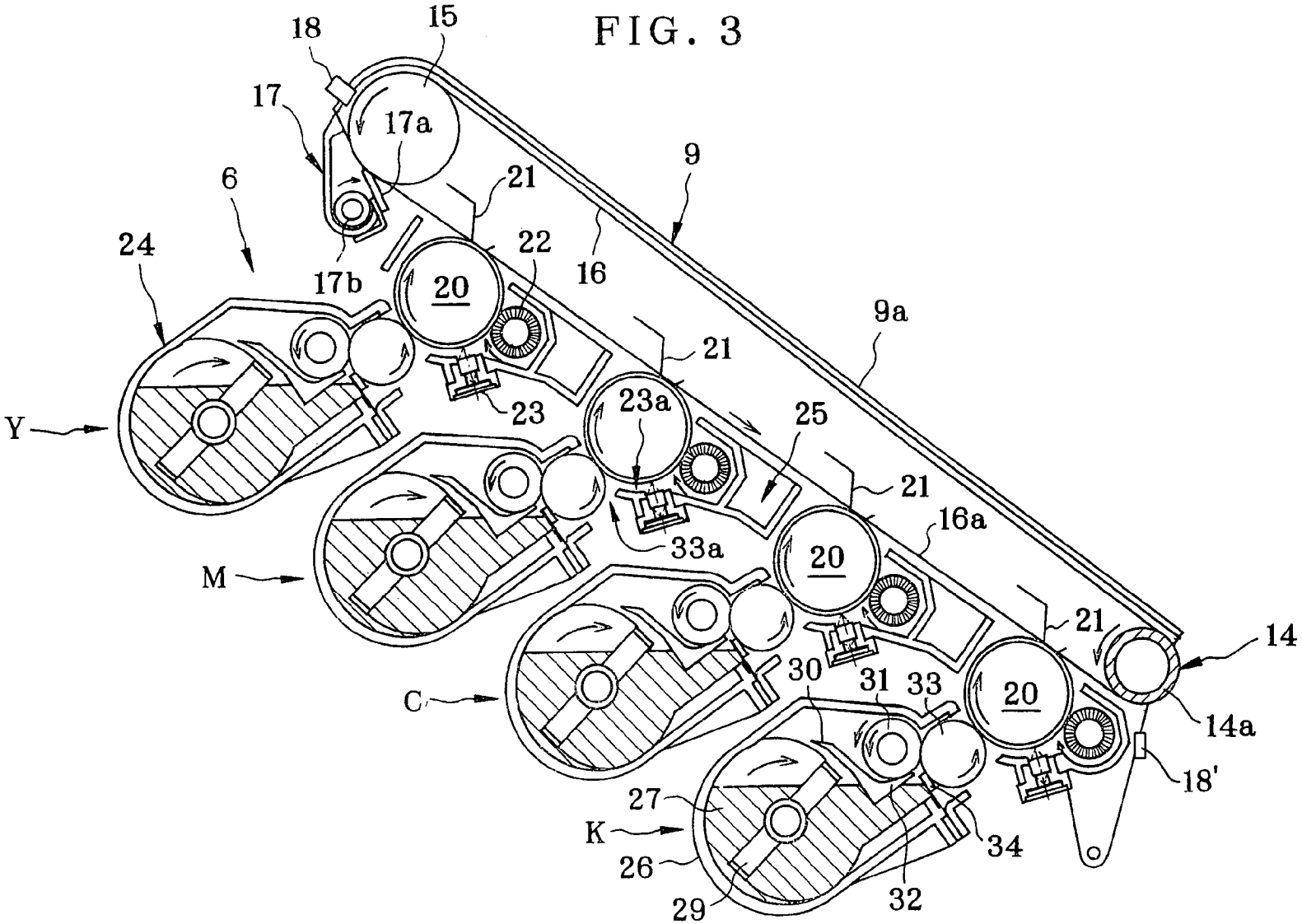
FIG. 3 is an enlarged view of a transfer belt unit and an image forming unit shown in FIG. 1.
Figure 4:
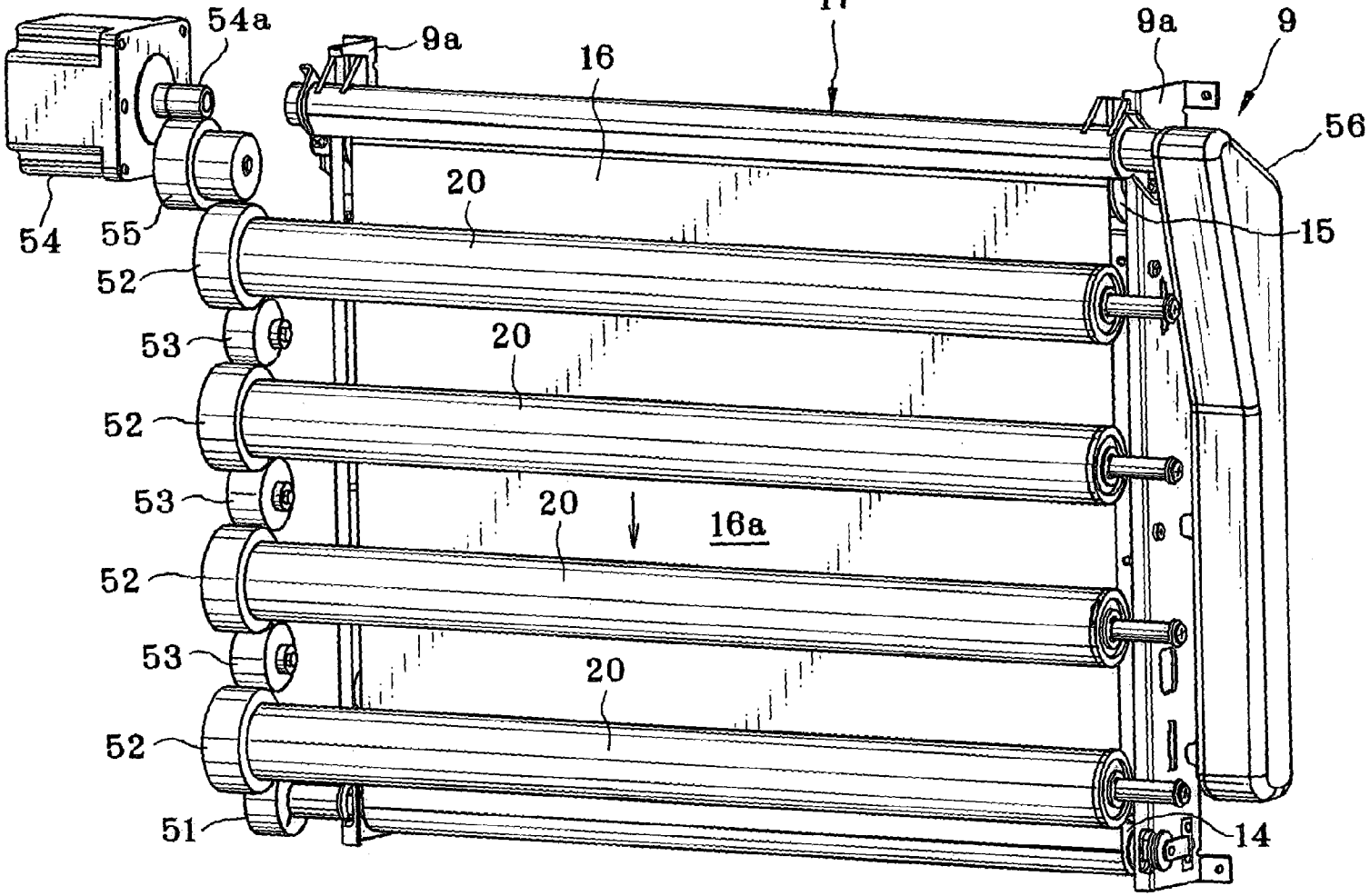
FIG. 4 is a perspective view of a transfer belt and an image carrier shown in FIG. 3.

Hereinafter, embodiments of the present invention will be described with reference to the attached drawings. FIG. 1 is a schematic sectional view showing the entire structure of an embodiment of an image forming apparatus of the present invention, FIG. 2 is a front view taken from the right side of FIG. 1, FIG. 3 is an enlarged view of a transfer belt unit and an image forming unit shown in FIG. 1, and FIG. 4 is a perspective view of a transfer belt and an image carrier shown in FIG. 3. In the following description, the same components used over the drawings will be marked with the same reference numerals, thereby sometimes omitting the explanation about such components. This embodiment is of a type employing an intermediate transfer belt as a transfer belt.

In FIG. 1, the image forming apparatus 1 of this embodiment comprises a housing body 2, a first door member 3 which is disposed on the front of the housing body 2 such that the first door member is openable and closable, and a second door member (also functioning as an outfeed tray) 4 which is disposed on the top of the housing body 2 such that the second door member is openable and closable. The first door member 3 is provided with an openable lid 3' which is disposed such that the openable lid 3' is openable and closable relative to the front of the housing body 2. The openable lid 3' can be opened and closed in conjunction with or independently from the first door member 3.

Disposed in the housing body 2 are an electrical component box 5 in which substrates for power source circuits and substrates for control circuits are housed, an image forming unit 6, a blower fan 7, a transfer belt unit 9, and a paper feeding unit 10. Disposed in the first door member 3 are a secondary transfer unit 11, a fixing unit 12, and a recording medium carrying means 13. Expendable supplies in the image forming units 6 and the paper feeding unit 10 are detachable relative to the body. In this case, by detaching the expandable supplies together with the transfer belt unit 9, the maintenance and replacement is allowed.

As shown in FIG. 2, the housing body 2 has two pairs of stays 2*a* which are disposed on both sides of a lower front surface of the housing body 2, respectively, to project from the front surface. The first door member 3 has pairs of pivotal portions 3*a* formed on both sides of a lower portion thereof. By inserting shafts 3*b* through the respective holes of the stays 2*a* and the pivotal portions 3*a*, the first door member 3 is attached to the housing body 2 such that the first door member 3 is openable and closable relative to the housing body 2. The first door member 3 is provided at an upper front surface thereof with a control panel 3*c*. The housing body 2 is provided with an opening 3*d* for insertion of the sheet cassette 35 below the first door member 3. In this embodiment, therefore, the respective units can be attached to and detached from the apparatus only by access from the front of the apparatus. This allows the apparatus to be placed in a narrow space.

In FIG. 1, the transfer belt unit 9 comprises a driving roller 14 which is disposed in a lower portion of the housing body 2 and is driven by a driving means (not shown) to rotate, a driven roller 15 which is disposed diagonally above the driving roller 14, an intermediate transfer belt 16 which is laid around the two rollers 14, 15 with some tension and is driven to circulate in a direction indicated by an arrow, and a cleaning means 17 which abuts on the surface of the intermediate transfer belt 16. The driven roller 15 and the intermediate transfer belt 16 are arranged obliquely to the upper left of the driving roller 14 in the drawings. Accordingly, during the operation of the intermediate transfer belt 16, a belt face 16*a* of which traveling direction is downward takes a lower side. In this embodiment, the belt face 16*a* is a tension side (side tensioned by the driving roller 14) at the time of driving the intermediate transfer belt 16.

The driving roller 14 and the driven roller 15 are rotatably supported by a support frame 9*a* which has a pivotal portion 9*b* formed at a lower end thereof. The pivotal portion 9*b* is fitted to a pivot shaft 2*b* disposed in the housing body 2, whereby the support frame 9*a* is attached to the housing body 2 such that it is pivotally movable. In addition, the support frame 9*a* has a lock lever 9*c* which is rotatably disposed at an upper end thereof. The lock lever 9*c* can latch a latch pin 2*c* disposed on the housing body 2.

The driving roller 14 also functions as a back-up roller for a secondary transfer roller 19 composing the secondary transfer unit 11. As shown in FIG. 3, formed on the peripheral surface of the driving roller 14 is a rubber layer 14*a* which is about 3 mm in thickness and $10^5\Omega\cdot cm^3$ or less in volume resistivity. The driving roller 14 has a metallic shaft which is grounded so as to function as a conductive path for secondary transfer bias supplied through the secondary transfer roller 19. Since the driving roller 14 is provided with the rubber layer 14*a* having high friction and a shock absorption, impact generated when a recording medium is fed into a second transfer section is hardly transmitted to the intermediate transfer belt 16, thereby preventing deterioration of image quality.

In this embodiment, the diameter of the driving roller 14 is set to be smaller than the diameter of the driven roller 15. This facilitates the separation of a recording medium after secondary transfer because of the elastic force of the recording medium itself. The driven roller 15 also functions as a back-up roller for the cleaning means 17.

The cleaning means 17 is located at the belt face 16*a* side, of which traveling direction is downward. As shown in FIG. 3, the cleaning means 17 comprises a cleaning blade 17*a* for removing toner remaining on the surface of the intermediate transfer belt 16 after the secondary transfer, and a toner carrying member 17*b* for carrying collected toner. The cleaning blade 17*a* is in contact with the intermediate transfer belt 16 at a position where is wrapped around the driven roller 15.

On the back of the belt surface 16*a*, of which traveling direction is downward, of the intermediate transfer belt 16, primary transfer members 21 composed of leaf spring electrodes are disposed. The primary transfer members 21 are pressed into contact with the back of the intermediate transfer belt 16 by their elastic force at locations corresponding to image carriers 20 of respective image forming stations Y, M, C, and K, described later. A transfer bias is applied to each primary transfer member 21.

In proximity to the lock lever 9*c*, an image density detecting means 18 is attached to the support frame 9*a* of the intermediate transfer belt 16 such that the image density detecting means 18 faces the intermediate transfer belt 16. The image density detecting means 18 is a sensor for positioning of toner images of respective colors on the intermediate transfer belt 16 by transferring a test pattern (resist mark or patch image) on the intermediate transfer belt and for detecting densities of respective toner images so as to compensate color registration errors and the densities of respective color images. It is preferable that a holding portion of holding the image density detecting means 18 is provided with a mechanism composed of screws or levers, not shown, for adjusting the position of the sensor relative to the intermediate transfer belt.

That is, in the image forming apparatus in which the intermediate transfer belt 16 is arranged such that the intermediate transfer belt 16 is pivotally movable relative to the housing body 2 about the pivot shaft 2*b* of the support frame 9*a*, the image detecting means 18 is disposed in proximity to the lock lever 9*c* so that the image density detecting means 18 is reliably positioned by the lock of the lock lever 9*c*, thereby preventing the deterioration of the detecting accuracy. Alternatively, as shown in FIG. 3, an image density detecting means 18' may be connected to the support frame 9*a*, in proximity to the roller 14 which is nearest to the pivot of the support frame 9*a*.

Normally, the test pattern formed on the intermediate transfer belt 16 is removed by the cleaning means 17 of the intermediate transfer belt 16 without being transferred to a recording medium. A method of moving the secondary transfer roller 19 apart from the intermediate transfer belt 16 during the test pattern printing is employed in order to avoid adhesion of toner to the surface of the secondary transfer roller 19. The movement of the secondary transfer roller 19 can avoid the adhesion of toner when the secondary transfer roller 19 is spaced apart from the intermediate transfer belt 16 only during the test pattern passes a nip portion between the second transfer roller 19 and the intermediate transfer belt 16. However, as the image forming speed (the belt traveling speed) increases, the secondary transfer roller 19 should be moved apart from and returned to the intermediate transfer belt 16 rapidly and frequently, thus producing severe impact on the intermediate transfer belt 16 with noise and varying the tension of the intermediate transfer belt 16. Accordingly, there is a possibility of creating a slight slip between the intermediate transfer belt 16 and the rollers supporting the intermediate transfer belt 16.

The slip causes a problem that color registration error occurs even when the timing compensation for image formation of the respective image forming stations is conducted by, for example, detecting resist marks. The formation of resist marks or patch images may be repeated until the positioning relation among respective color images and the density of toner image reaches a desired range, so the second transfer roller 19 is repeatedly moved apart from or returned to abut on the intermediate transfer belt 16, leading to failure of a shifting mechanism of moving the secondary transfer roller 19 and thus damaging the reliability of the image forming apparatus.

To avoid the aforementioned problems, in this embodiment, the secondary transfer roller 19 is moved apart from the intermediate transfer belt 16 before starting the formation of a series of test patterns and the secondary transfer roller 19 is returned to abut on the intermediate transfer belt 16 at such a slow speed not to create a slight slip between the intermediate transfer belt 16 and the rollers supporting and driving the belt after the series of test patterns repeatedly formed pass a position where the secondary transfer roller 19 faces the intermediate transfer roller 16.

The image forming unit 6 comprises the image forming stations Y (for yellow), M (for magenta), C (for cyan), and K (for black) for forming multi-color images (in this embodiment, four-color images). As clearly shown in FIG. 3, each image forming station Y, M, C, K has an image carrier 20 composed of a photosensitive drum, a charging means 22, image writing means 23, and developing means 24 which are arranged around the image carrier 20. Only reference numerals for the charging means 22, the image writing means 23, and the developing means 24 of the image forming station Y are indicated on the drawings and the indication of the reference numerals for the other image forming stations is omitted because the image forming stations have the same structure. It should be understood that the image forming stations Y, M, C, K may be arranged in any order.

The image forming stations Y, M, C, K are disposed such that the respective image carriers 20 are in contact with the belt face 16*a*, of which traveling direction is downward, of the intermediate transfer belt 16. As a result of this, the image forming stations Y, M, C, K are arranged in an obliquely leftward direction relative to the driving roller 14 in the drawings. Each image carrier 20 is driven to rotate in the traveling direction of the intermediate transfer belt 16 as indicated by arrows.

The charging means 22 is a conductive brush roller which is connected to a high-voltage source and rotates at a peripheral speed about twice to triple the speed of the image carrier 20 as a photoreceptor in opposite direction with being in contact with the surface of the image carrier 20 so as to uniformly charge the surface of the image carrier 20. The conductive brush roller comprises a well-conductive shaft member (for example, metal shaft) of 5–8 mm in diameter and a fabric wound around the shaft member in spiral form, wherein the fabric is filled with semi-conductive fibers of 2–6 deniers in thickness and of $10^7$–$10^9$ Ω in electrical resistance of yarns to have 150,000 to 430,000 piles per a square inch. The brush roller is rotatably held such a manner as to have contact depth of 0.3–0.5 mm relative to the image carrier 20.

In case of using a photoreceptor of a type to be negatively charged as the image carrier 20, preferable voltage to be applied to the brash roller is a voltage composed of a direct current component in a range from −300 V to −500 V and an alternating current component in a range from 800 V to 1300 V of a frequency on the order of 1 kHz is superimposed on the direct current component. In case of an image forming apparatus of a cleaner-less type just like this embodiment, it is preferable that a bias of a polarity opposite to the polarity of charged toner is applied to the brush roller during non image forming, whereby residual toner adhering to the brush roller is emitted to the image carrier 20, is transferred to the intermediate transfer belt 16 at the primary transfer portion, and is collected by the cleaning means 17 of the intermediate transfer belt 16.

Since the charging means 22 enables charging of the surface of the image carrier with extremely small amount of electric current, the charging means never pollute inside and outside of the apparatus with large amount of ozone like in case of using a corona charging method. In addition, since the charging means 22 softly touch the image carrier 20, adhesion of toner remaining after transfer onto a charging roller and an image carrier which easily occurs in case of using a roller charging method hardly occurs, thereby ensuring the stability of the image quality and the reliability of the apparatus.

The image writing means 23 employs an array-type writing head in which elements such as liquid crystal shutters having a light-emitting diode and a backlight are aligned in line(s) in the axial direction of the image carrier 20. The array-type writing head is more compact than a laser scanning optical system because of its short optical path length so that the array-type writing head can be arranged in proximity to the image carrier 20, thereby miniaturizing the entire apparatus. In this embodiment, the image carrier 20, the charging means 22, and the image writing means 23 of each image forming station Y, M, C, K are united together into an image carrier unit 25 (FIG. 3), thereby keeping the position of the array-type writing head. When the image carrier unit 25 is replaced, the array-type writing head is also replaced together. After that, the light volume adjustment and positioning are conducted relative to a new image carrier unit and then is put into service again.

Then, details of the developing means 24 will be described by taking the image forming station K of FIG. 3 as an example. In this embodiment, since the image forming stations Y, M, C, K are obliquely arranged and the image carriers 20 are disposed to be in contact with the belt face 16*a*, of which traveling direction is downward, of the intermediate transfer belt 16, toner storage containers 26 are arranged obliquely downward to the lower left of the image carriers 20. For this, special structure is employed in the developing means 24.

That is, the developing means 24 each comprises the toner storage container 26 storing toner (indicating by hatching), a toner storage area 27 formed in the toner storage container 26, a toner agitating member 29 disposed inside the toner storage area 27, a partition 30 defined in an upper portion of the toner storage area 27, a toner supply roller 31 disposed above the partition 30, a blade 32 attached to the partition 30 to abut the toner supply roller 31, the development roller 33 arranged to abut both the toner supply roller 31 and the image carrier 20, and a regulating blade 34 arranged to abut the development roller 33.

The image carrier 20 is rotated in the traveling direction of the intermediate transfer belt 16. The development roller 33 and the supply roller 31 are rotated in a direction opposite to the rotational direction of the image carrier 20 as shown by arrows. On the other hand, the agitating member 29 is rotated in a direction opposite to the rotational direction of the supply roller 31. Toner agitated and scooped up by the agitating member 29 in the toner storage area 27 is supplied to the toner supply roller 31 along the upper surface of the partition 30. Friction is caused between the toner and the flexible blade 32 so that mechanical adhesive force and adhesive force by triboelectric charging are created relative to the rough surface of the supply roller 31. By these adhesive forces, the toner is supplied to the surface of the development roller 33. The toner supplied to the development roller 33 is regulated into a coating layer having a predetermined thickness by the regulating blade 34. The toner layer as a thin layer is carried to the image carrier 20 so as to develop a latent image on the image carrier 20 at and near a nip portion which is a contact portion between the development roller 33 and the image carrier 20.

In this embodiment, the development roller 33 disposed facing the image carrier 20, the toner supply roller 31, and the contact portion of the regulating blade 34 relative to the development roller 33 are not submerged in the toner in the toner storage area 27. This arrangement can prevent the contact pressure of the regulating blade 34 relative to the development roller 33 from being varied due to the decrease of the stored toner. In addition, since excess toner scraped from the development roller 33 by the regulating blade 34 spills onto the toner storage area 27, thereby preventing filming of the development roller 33.

The contact portion between the development roller 33 and the regulating blade 34 is positioned below the contact portion between the supply roller 31 and the development roller 33. There is a passage for returning excess toner, which was supplied to the development roller 33 by the supply roller 31 but not transmitted to the development roller 33, and excess toner, which was removed from the development roller 33 by the regulating operation of the regulating blade 34, to the toner storage area 27 at the lower portion of the developing means. The toner returned to the toner storage area 27 is agitated with toner in the toner storage area 27 by the agitating member 29, and is supplied to a toner inlet near the supply roller 31 again. Therefore, the excess toner is let down to the lower portion without clogging the friction portion between the supply roller 31 and the development roller 33 and the contact portion between the development roller 33 and the regulating blade 34 and is then agitated with toner in the toner storage area 27, whereby the toner in the developing means deteriorates slowly so that portentous changes in image quality just after the replacement of the developing means is prevented.

Further details will be described by taking the image forming station M of FIG. 3 as an example. The developing means 24 has a development roller aperture 33*a* disposed adjacent to the development roller 33. The image writing means 23 has an upward opening 23*a* which opens upwardly to the image carrier 20. If the upward opening 23*a* of the image writing means 23 is positioned below the development roller aperture 33*a*, toner spills from the development roller aperture 33*a* because of the gravity and thus enters into the image writing means 23 through the upward opening 23*a* so as to undesirably stain the image writing means 23.

In this embodiment, the upward opening 23*a* of the image writing means. 23 is offset toward the intermediate transfer belt 16 from the development roller aperture 33*a* of the developing means 24 such that the upward opening 23*a* does not overlap relative to the development roller aperture 33*a*. This can solve the possible problem that toner spills from the development roller aperture 33*a* because of the gravity and thus enters into the image writing means 23 through the upward opening 23*a* so as to undesirably stain the image writing means 23.

Returning to FIG. 1, the sheet supply unit 10 comprises a sheet cassette 35 in which a pile of recording media P are held, and a pick-up roller 36 for feeding the recording media P from the sheet cassette 35 one by one.

Arranged inside the first door member 3 are a pair of resist rollers 37 for regulating the feeding of a receiving medium P to the secondary transfer portion at the right time, a secondary transfer unit 11 as a secondary transfer means abutting on and pressed against the driving roller 14 and the intermediate transfer belt 16, a fixing unit 12, the recording medium carrying means 13, a pair of outfeed rollers 39, and a dual-side printing passage 40.

The secondary transfer unit 11 comprises a pivot lever 42 pivotally supported to a fixed shaft 41, the secondary transfer roller 19 rotatably mounted to an end of the pivot lever 42, and a spring 43 disposed between the other end of the pivot lever 42 and the first door member 3. Normally, the secondary transfer roller 19 moves in a direction of arrow by the biasing force of the spring 43 and thus is pressed against the intermediate transfer belt 16 and the driving roller 14. An eccentric cam 44 is arranged on the spring side of the pivot lever 42. The pivot lever 42, the spring 43, and the eccentric cam 44 cooperate together to compose the shifting means for the secondary transfer roller 19. By the rotation of the eccentric cam 44, the pivot lever 42 pivots against the biasing force of the spring 43 so that the secondary transfer roller 19 is moved away from the intermediate transfer belt 16.

The fixing unit 12 comprises a fuser roller 45 which has a built-in heating element such as a halogen heater and which is freely rotatable, a pressure roller 46 pressing the fuser roller 45, a belt tensioning member 47 which is disposed to freely swing relative to the pressure roller 46, and a heat resistant belt 49 which is lied around the pressure roller 45 and the belt tensioning member 47. A color image secondarily transferred to a recording medium is fixed to the recording medium at the nip portion formed between the fuser roller 45 and the heat resistant belt 49 at a predetermined temperature. In this embodiment, the fixing unit 12 can be arranged in a space formed obliquely upward the intermediate transfer belt 16, that is, a space formed on the opposite side of the image forming units 6 relative to the intermediate transfer belt 16. This arrangement enables the reduction in heat transfer to the electrical component box 5, the image forming unit 6, and the intermediate transfer belt 16, and lessens the frequency of taking the action for correcting color registration error.

FIG. 4 shows the transfer belt unit 9, the intermediate transfer belt 16, the cleaning means 17, and the image carriers 20 of the respective image forming stations Y, M, C, and K as described with reference to FIG. 1. The transfer belt unit 9 comprises a pair of right and left side frames 9*a*. The driving roller 14 and the driven roller 15 are attached to the frames 9*a*. The intermediate transfer belt 16 is laid around the driving roller 14 and the driven roller 15 with some tension. One end of the driving roller 14 is connected to a belt driving gear 51 and one end of each image carrier 20 is connected to image carrier driving gear 52. Idle gears 53 are provided such that each idle gear 53 is meshed with each pair of the adjacent driving gears 52. The driving motor 54 is located near the uppermost position of the belt face 16*a* of which traveling direction is downward. A transmission gear 55 which is a combination gear is meshed with a pinion gear 54*a* fixed to the rotational shaft of the driving motor 54 and meshed with the driving gear 52 of the uppermost image carrier 20. Numeral 56 designates a toner collecting container into which waste toner removed by the cleaning means 17 is collected. The toner collecting container 56 is shaped to extend along the side of the frame 9*a*, thereby also miniaturizing the entire apparatus.

In the above arrangement, the respective image carriers 20 are rotatably supported by a pair of frames (not shown) and are driven by the single driving motor 54 disposed near the upper portion of the intermediate transfer belt 16 because the rotation of the driving motor 54 are sequentially transmitted by the transmission gear 55, the image carrier driving gears 52, and the idle gears 53. The rotation is further transmitted from the lowermost image carrier driving gear 52 to the driving roller 14 of the intermediate transfer belt 16 via the belt driving gear 51 so as to drive the driving roller 14. The number of teeth of the idle gear 53 is set to be the same as the number of teeth of the belt driving gear 51 so as to synchronize their rotational periods to make one period of the driving roller 14 substantially equal to the interval of the primary transferring portion of each image forming means. Therefore, the rotational phases among the respective image carriers 20 and the gears can be set in the manufacturing process. Even after the image carriers 20 are replaced, there is a minimized possibility of occurrence of color registration error due to the periodic error among the respective image carriers 20.

In this case, the feeding speed of the transfer belt 16 is set to be faster than the peripheral velocity of the image carriers 20 by approximately 1–3%, thereby preventing the slack of the transfer belt 16 and thus achieving the stable driving of the transfer belt. It can also prevents the occurrence of color registration error so as to improve the image quality and can avoid the necessity of providing the cleaning means because the transfer efficiency is improved by setting a velocity differential.

In the image forming apparatus of this embodiment, as shown in FIG. 1, the intermediate transfer belt 16 and the image forming stations Y, M, C, and K are obliquely arranged in the housing body 2 and the electrical component box 5 is disposed below the image forming stations Y, M, C, and K. The wirings (shown by two-dot chain line of FIG. 1) from electrical circuits such as a power source circuit and a control circuit in the electrical component box 5 are connected to the primary transfer members 21, the charging means 22, the image writing means 23, and the image density detecting means 18 via a connector 57. The wirings may be connected to the secondary transfer unit 11, the fixing unit 12, and the like in the first door member 3 via the connector 57 or by passing near the shafts 3*b* of the first door member 3.

The electrical circuits are an interface circuit for converting image data from an outside host controller into data recordable in the image forming stations, a control circuit for controlling the image forming apparatus, high-voltage power supply for supplying high voltage to charging means, developing means, transfer means, and the like, low-voltage power supply for operating a driving motor, clutch, and a control circuit of the apparatus.

By arranging the electrical circuits below the image forming stations and above the sheet cassette 35, the necessity of increasing the width, the depth, and the height of the entire apparatus because of the installation of the electrical circuits can be eliminated, thereby achieving the compact image forming apparatus.

In addition, by arranging the interface circuit and the control circuit as mentioned above and connecting the wirings from the positions near the respective connected portions of the circuit substrates to the image writing means 23 and the image density detecting means 18 via the connector 57, the length of the wirings to the image writing means 23 can be shortened, thereby reducing the wiring cost and also reducing noise produced during the transmission of image signals of high frequency such as several hundred MHz to the image writing means 23. Moreover, by arranging the high-voltage power supply and the low-voltage power supply as mentioned above and connecting the wirings from the positions near the respective connected portions of the circuit substrates to the charging means and the transfer means via the connector 57, the length of the wirings can be shortened, thereby not only reducing the wiring cost and but also preventing the waveform distortion of a bias composed of an alternating current voltage superimposed on a direct current voltage and preventing the power loss.

Further, there is no necessary to arrange a lot of wirings via the shafts of the door member 3 which are complex, thereby avoiding the possibility that wirings are nipped and thus broken during the rotation of the frame 9*a* on which the transfer belt and the image carriers are mounted for the maintenance of the apparatus.

The actions of the image forming apparatus as a whole will be summarized as follows:

(1) As a printing command (image forming signal) is inputted into the control unit in the electric component box 5 from a host computer (personal computer) (not shown) or the like, the image carriers 20 and the respective rollers of the developing means 24 of the respective image forming stations Y, M, C, K, and the intermediate transfer belt 16 are driven to rotate.

(2) The outer surfaces of the image carriers 20 are uniformly charged by the charging means 22.

(3) In the respective image forming stations Y, M, C, K, the outer surfaces of the image carriers 20 are exposed to selective light corresponding to image information for respective colors by the image writing means 23, thereby forming electrostatic latent images for the respective colors.

(4) The electrostatic latent images formed on the image carriers 20 are developed by the developing means 24 to form toner images.

(5) The primary transfer voltage of the polarity opposite to the polarity of the toner is applied to the primary transfer members 21 of the intermediate transfer belt 16, thereby transferring the toner images formed on the image carriers 20 onto the intermediate transfer belt 16 one by one. According to the movement of the intermediate transfer belt 16, the toner images are superposed on the intermediate transfer belt 16.

(6) In synchronization with the movement of the intermediate transfer belt 16 on which primary images are transferred, a receiving medium P accommodated in the sheet cassette 35 is fed to the secondary transfer roller 19 through the pair of resist rollers 37.

(7) The primary-transferred image meets with the receiving medium at the secondary transfer portion. A bias of the polarity opposite to the polarity of the primary transferred image is applied by the secondary transfer roller 19 which is pressed against the driving roller 14 for the intermediate transfer belt 16 by the pressing mechanism, whereby the primary-transferred image is secondarily transferred to the receiving medium fed in the synchronization manner.

(8) Residual toner after the secondary transfer is carried toward the driven roller 15 and is scraped by the cleaning means 17 disposed opposite to the roller 15 so as to refresh the intermediate transfer belt 16 to allow the above cycle to be repeated.

(9) The receiving medium passes through the fixing means 12, whereby the toner image on the receiving medium is fixed. After that, the receiving medium is carried toward a predetermined position (toward the outfeed tray 4 in case of single-side printing, or toward the dual-side printing passage 40 in case of dual-side printing).

Figure 5:
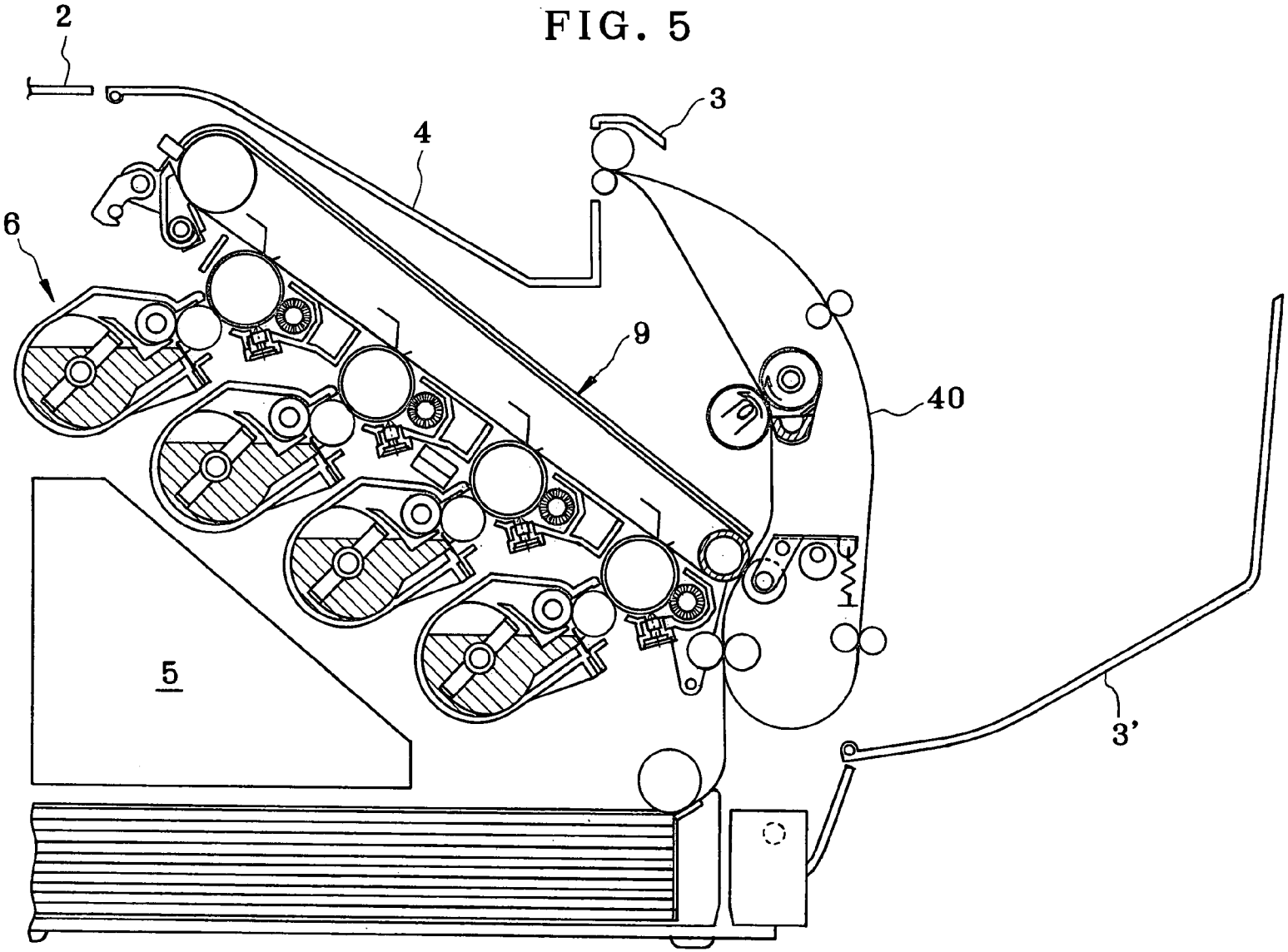
FIG. 5 is an illustration for explaining the replacement of expendable supplies in the embodiment of FIG. 1.

Now, with reference to FIG. 5 through FIG. 10, the removal of a jammed recording medium and the replacement of the expendable supplies will be described. FIG. 5 is a state that only the openable lid 3' of the first door member 3 is pivotally moved downwards to expose the dual-side printing passage 40. In this state, it is possible to remove recording media jammed at the dual-side printing passage 40.

Figure 6:
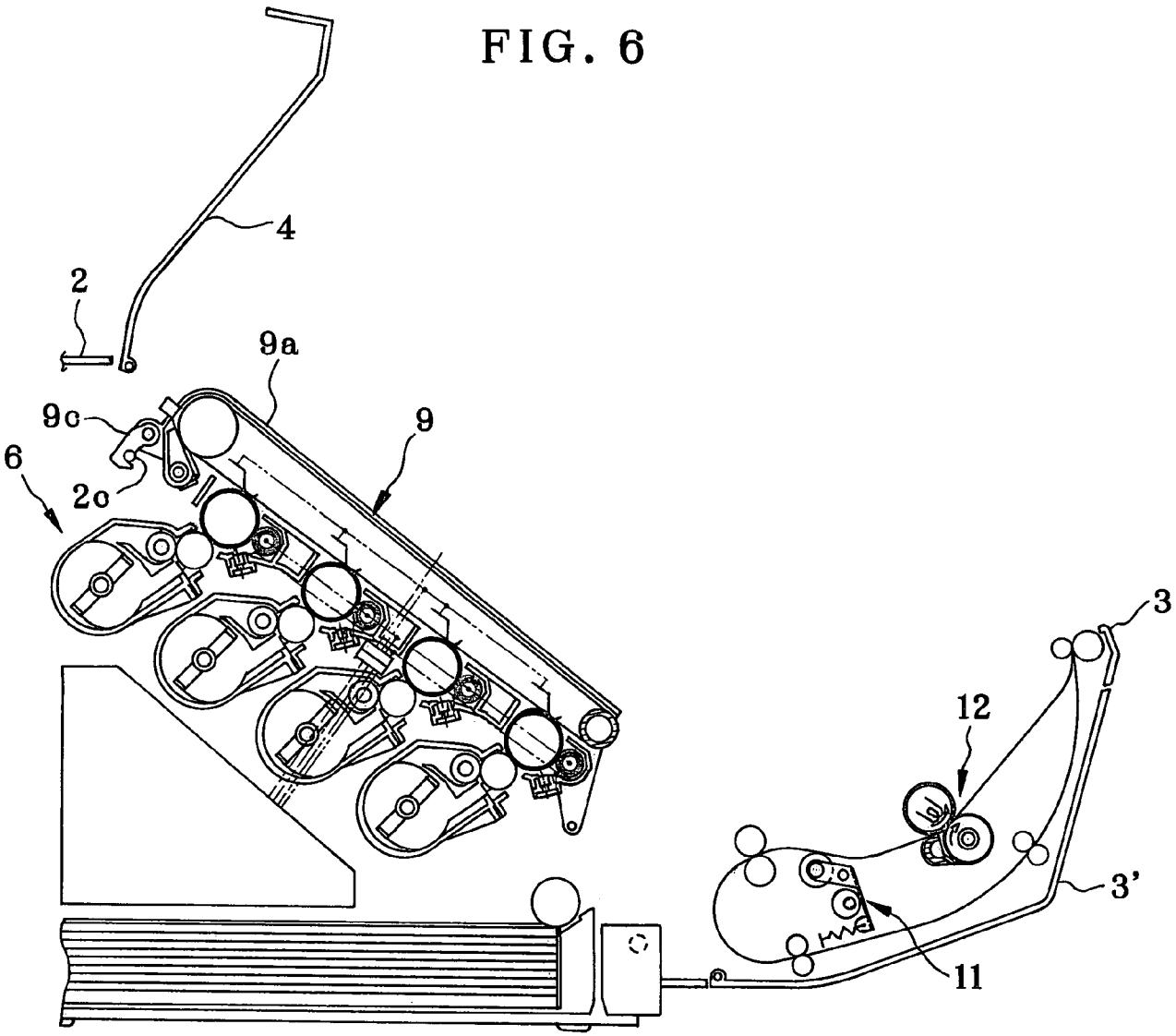
FIG. 6 is an illustration for explaining the replacement of the expendable supplies and showing the state following the state shown in FIG. 5.

FIG. 6 shows a state that the first door member 3 is pivotally moved downwards together with the openable lid 3' to expose the fixing unit 12 and the secondary transfer unit 11. In this state, it is possible to remove recording media jammed at the fixing unit 12 and the secondary transfer unit 11 and it is also possible to easily repair or replace the fixing unit 12 and the secondary transfer unit 11. In addition, the second door member 4 is pivotally moved upwards to expose the transfer belt unit 9, whereby it is possible to remove recording media jammed at the transfer belt unit 9.

Figure 7:
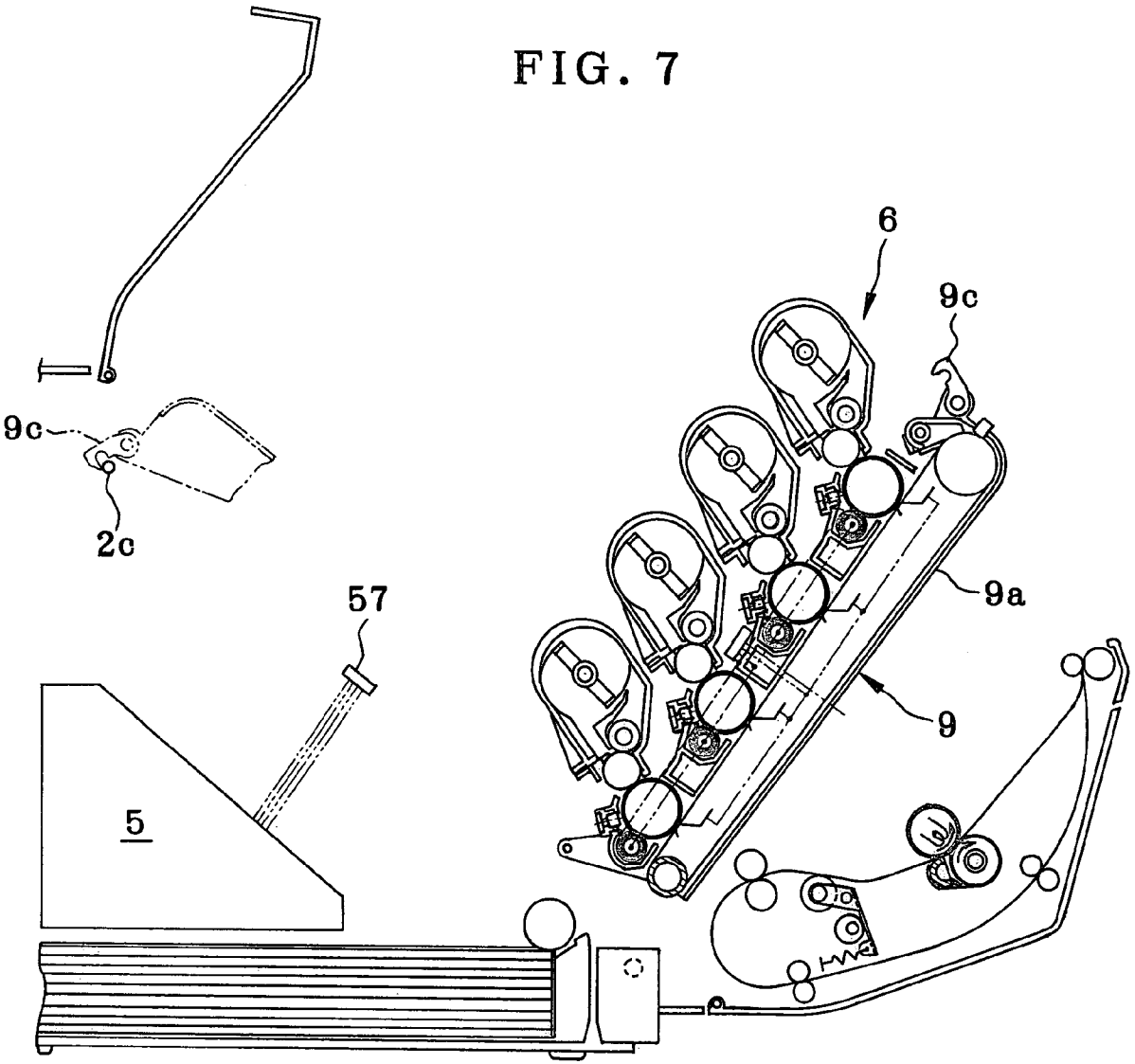
FIG. 7 is an illustration for explaining the replacement of the expendable supplies and showing the state following the state shown in FIG. 6.

FIG. 7 shows a state that the lock lever 9*c* provided on the top of the frame 9*a* of the transfer belt unit 9 is pivotally moved to disengage itself from the latch pin 2*c* and the frame 9*a* is pivotally moved to the right about the pivot shaft 2*b* so as to expose the image forming unit 6. During this, the connection of the wirings at the connector 57 is cancelled.

Figure 8:
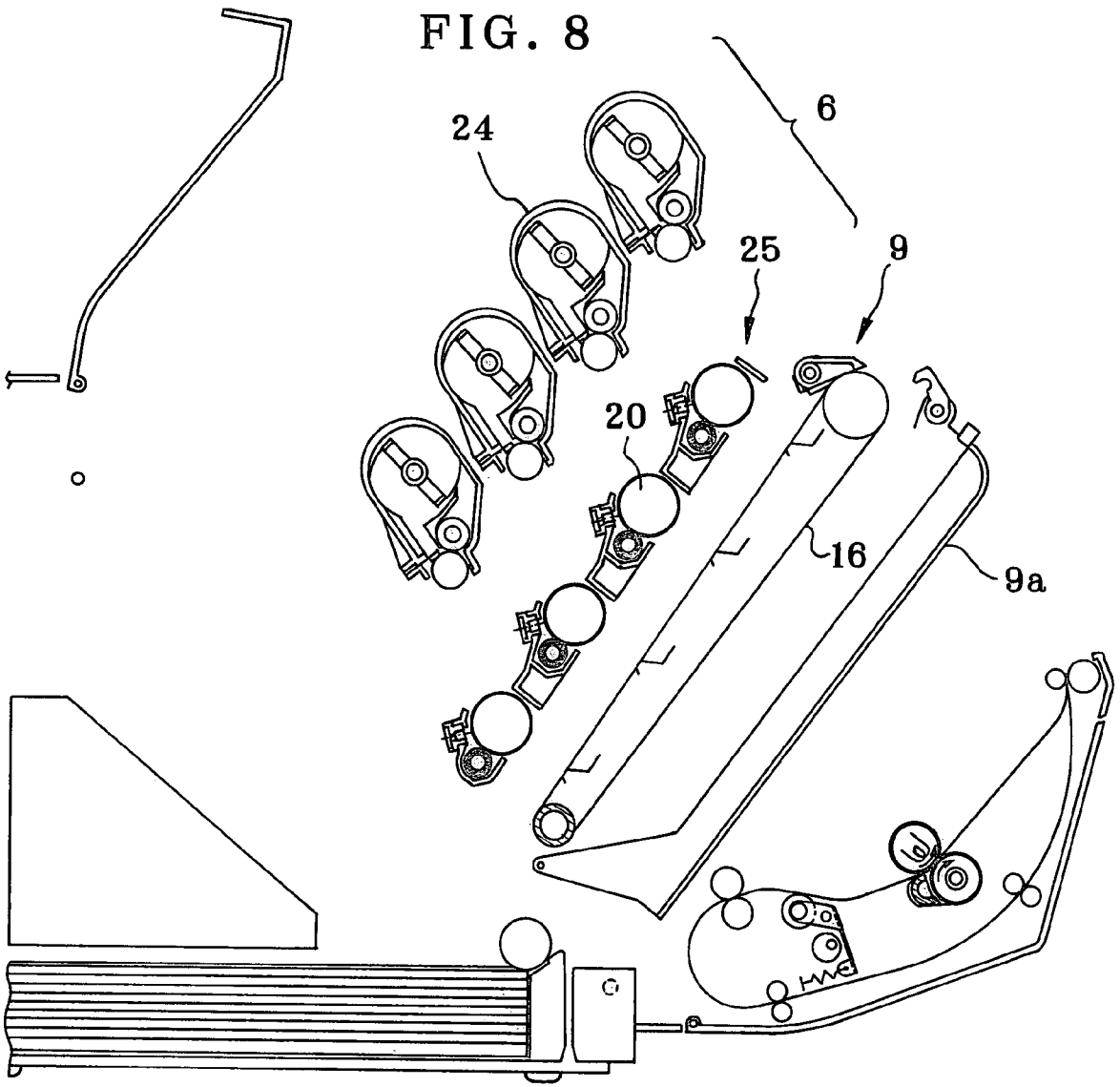
FIG. 8 is an illustration for explaining the replacement of the expendable supplies and showing the state following the state shown in FIG. 7.

Then, as shown in FIG. 8, the respective developing means 24 composing the image forming unit 6, the image carrier unit 25, and the transfer belt unit 9 are detached from the frame 9*a*, thereby allowing the repair and replacement of them. In this embodiment, since it is easy to ensure the positional relations among the developing means 24, the image carriers 20, and the intermediate transfer belt 16, thus facilitating the replacement operation.

Figure 9:
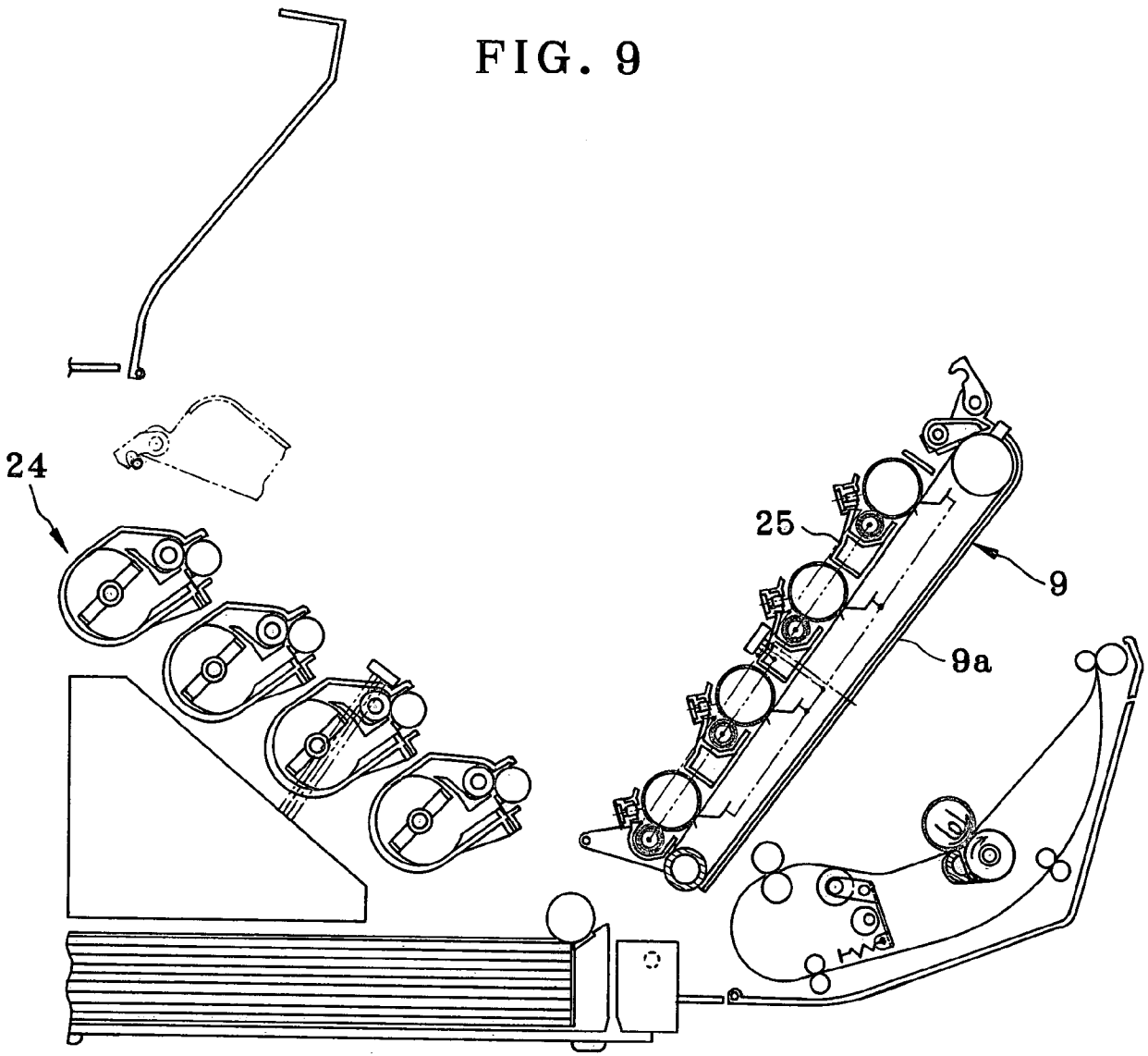
FIG. 9 is an illustration showing a variation example of the embodiment shown in FIG. 8.
Figure 10:
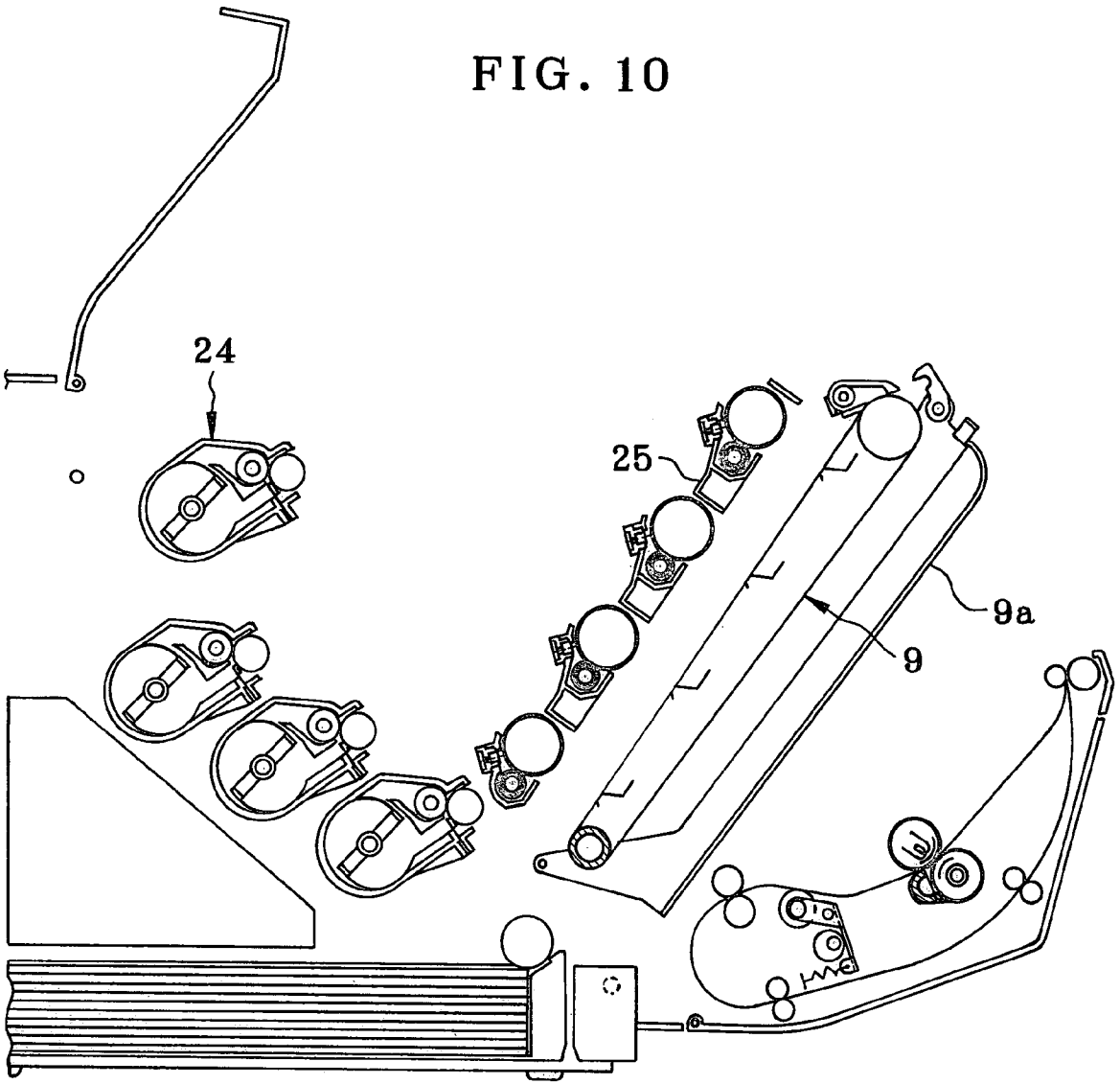
FIG. 10 is an illustration for explaining the replacement of the expendable supplies and showing the state following the state shown in FIG. 9.

FIG. 9 and FIG. 10 show a variation example of the embodiment shown in FIG. 8. In this variation example, the transfer belt unit 9 and the image carrier unit 25 are supported by the frame 9*a* and the developing means 24 are supported at the housing body 2 side. Therefore, the image carrier unit 25 and the developing means 24 can be selectively replaced independently from each other. It should be noted that the image carrier unit 25 may be supported at the housing body 2 side.

In this embodiment, since the first door member 3 as the apparatus cover, the fixing unit 12, and the secondary transfer unit 11 are opened together into a space for inserting and drawing the sheet cassette 35 for supply of recording media, the apparatus has good operationality for maintenance of the fixing unit 12 and a high level of visibility and good operationality when a recording medium is jammed. In addition, since at least one of the transfer belt unit 9, the image carrier unit 25, and the developing means 24 can be opened in the space above the opened first door member 3 to allow the replacement of the image carriers 20 and/or the developing means 24, the apparatus also has good operationality for replacement of the expendable supplies.

Unlike the conventional technique, since it is not necessary to form a large access opening for replacing the expendable supplies in the frame supporting the image forming means, the rigidity of the frame is increased, thereby stably obtaining high-quality images.

It can prevent an operator from touching the transfer belt when the frame 9*a* is opened and thus prevent the occurrence of image defect due to fingerprints putted by the touching. In addition, even if toner spills during the replacement of expendable supplies, the toner can be received by the frame 9*a*, thereby preventing the recording medium carrying means 13, the fixing unit 12, and the secondary transfer unit 11 from being stained.

Moreover, since the secondary transfer roller 19 is moved apart from the intermediate transfer belt 16 according to the opening of the first door member 3, recording media jammed around the transfer belt 16 during printing plural recording media can be easily removed.

Figure 11:
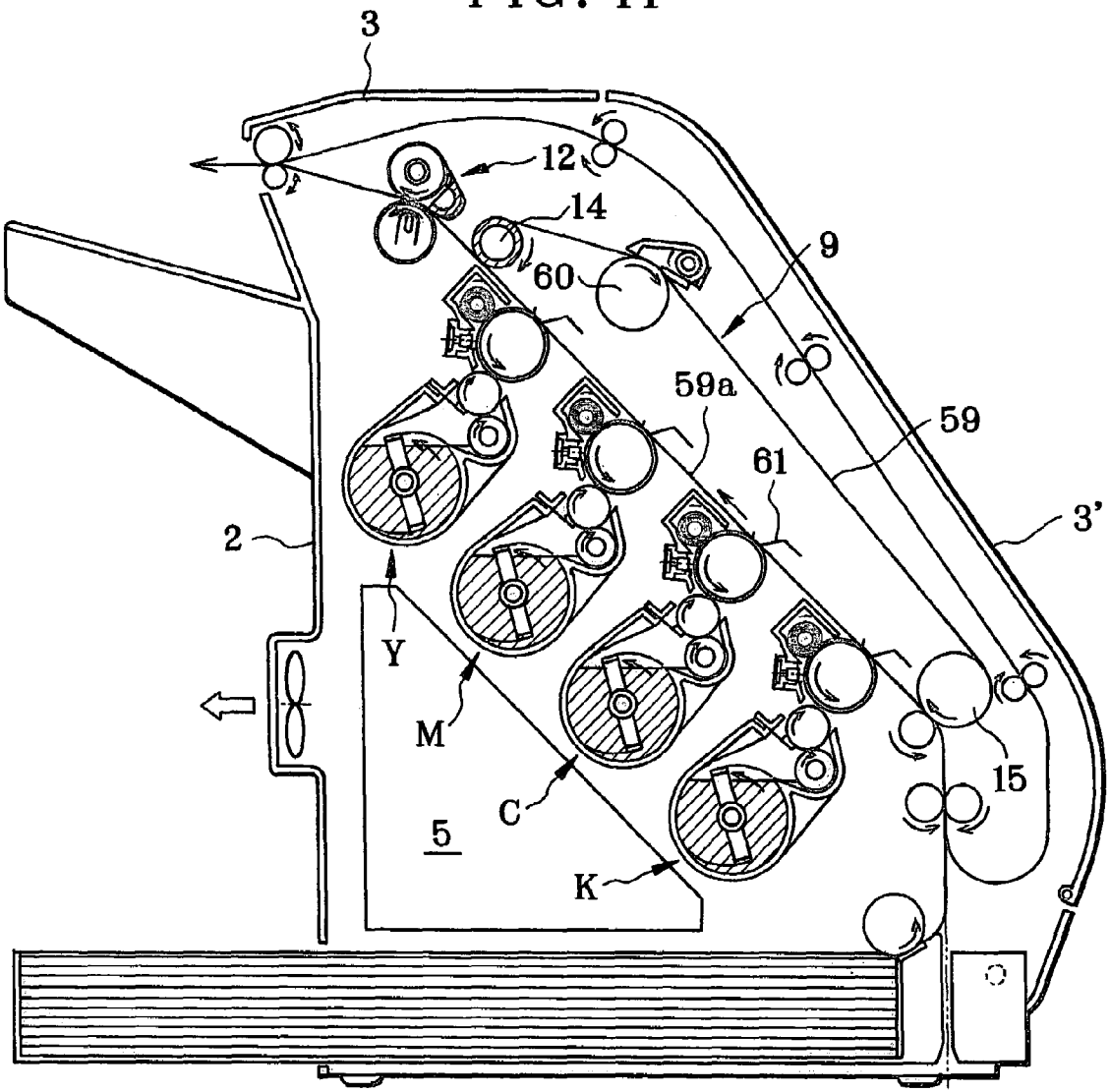
FIG. 11 is a schematic sectional view showing the entire structure of another embodiment of the image forming apparatus of the present invention.

FIG. 11 is a schematic sectional view showing the entire structure of another embodiment of the image forming apparatus of the present invention. It should be noted that the same components as those of the embodiment of FIG. 1 are marked with the same numerals, so description of such components will be omitted. This embodiment is of a type employing a paper carrying belt as a transfer belt. That is, instead of the intermediate transfer belt 16 of FIG. 1, a paper carrying belt 59 is employed.

In this embodiment, a transfer belt unit 9 and a fixing unit 12 are arranged in a first door member 3. The transfer belt unit 9 comprises a driving roller 14 which is disposed in an upper portion of a housing body 2 and is driven by a driving means (not shown) to rotate, a driven roller 15 and a backup roller 60 which are disposed diagonally below the driving roller 14, a paper carrying belt 59 which is laid around the three rollers with some tension and is driven to circulate in a direction indicated by an arrow, and a cleaning means 17 which abuts on the surface of the paper carrying belt 59 to oppose the backup roller 60. The driving roller 14 and the paper carrying belt 59 are arranged obliquely to the upper left of the driven roller 15. Accordingly, a belt tension side 59*a* at the time of driving the paper carrying belt 59 is on the lower side and a belt slack side is on the upper side.

On the back of the paper carrying belt 59, transfer members 61 composed of leaf spring electrodes are disposed. The transfer members 61 are pressed into contact with the back of the paper carrying belt 59 by their elastic force at locations corresponding to image carriers 20 of respective image forming stations Y, M, C, and K. A transfer bias is applied to each transfer member 61. The image carriers 20 of the image forming stations Y, M, C, K are in contact with the belt tension side 59*a* of the paper carrying belt 59. As a result of this, the image forming stations Y, M, C, K are arranged in an obliquely leftward direction relative to the driven roller 15 in FIG. 11.

Figure 12:
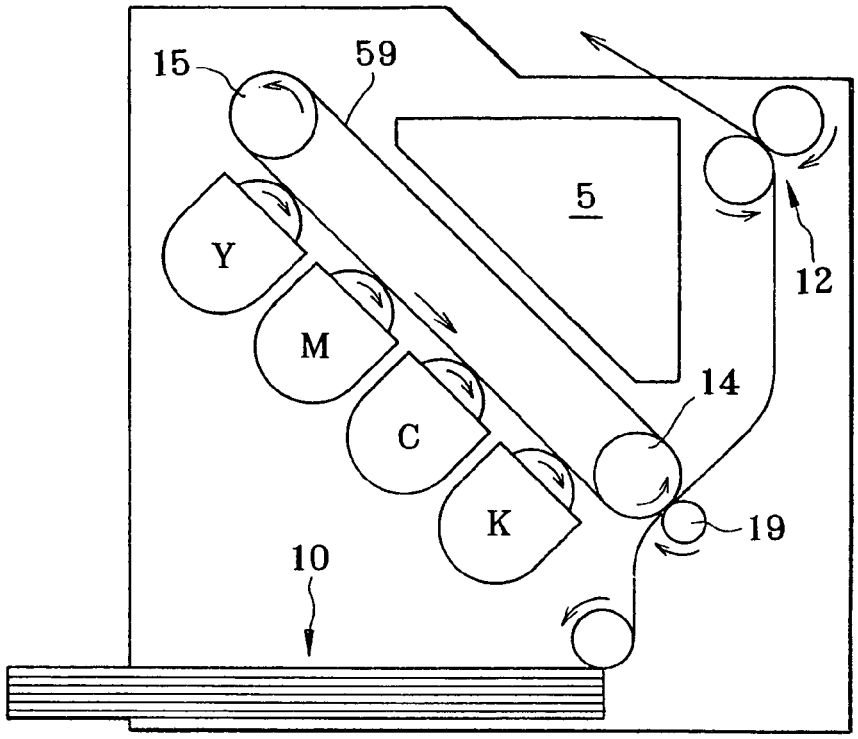
FIG. 12 is a schematic illustration showing another embodiment of the image forming apparatus of the present invention.
Figure 13:
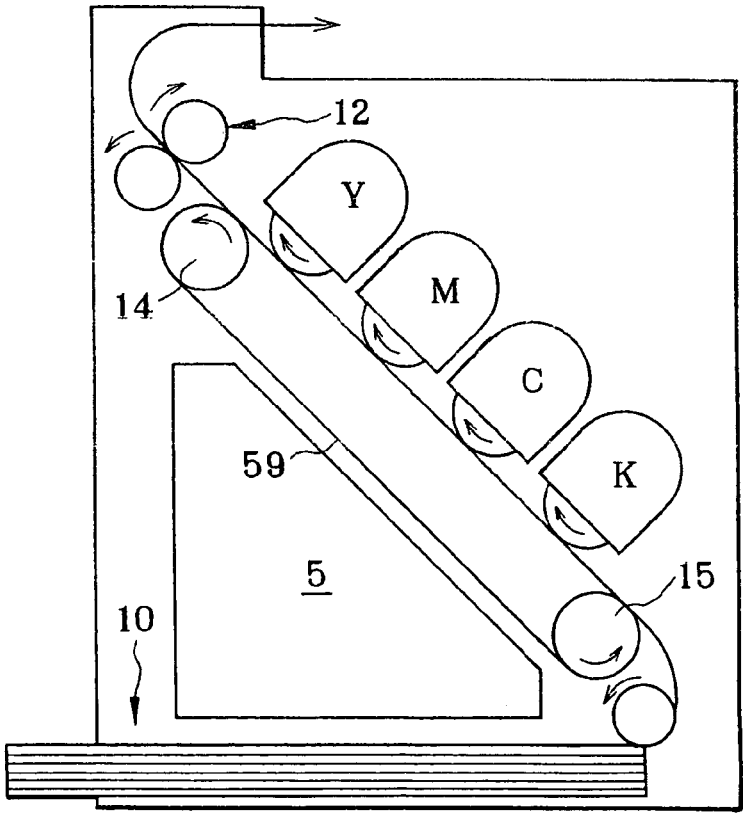
FIG. 13 is a schematic illustration showing another embodiment of the image forming apparatus of the present invention.
Figure 14:
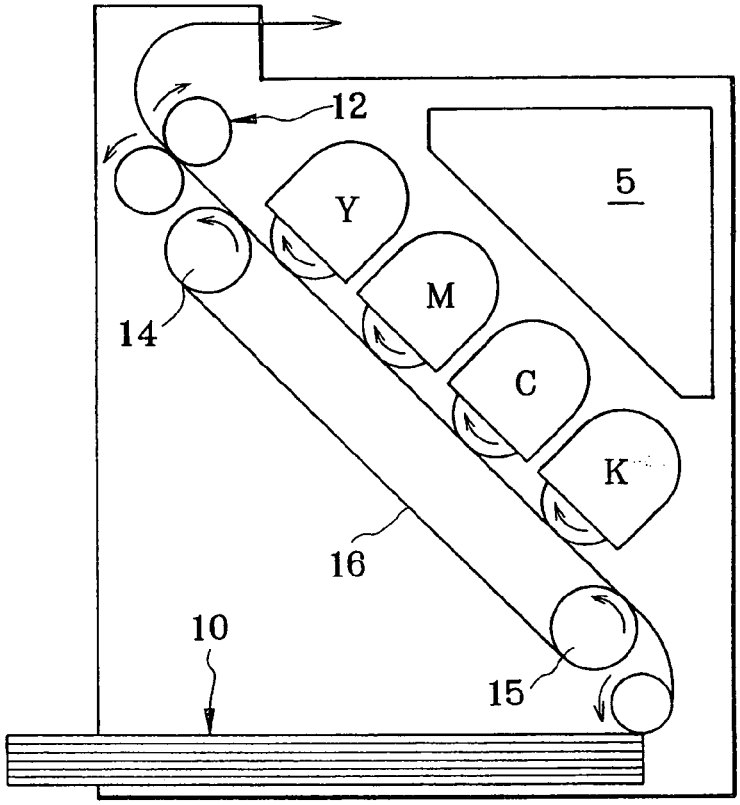
FIG. 14 is a schematic illustration showing another embodiment of the image forming apparatus of the present invention.
Figure 15:
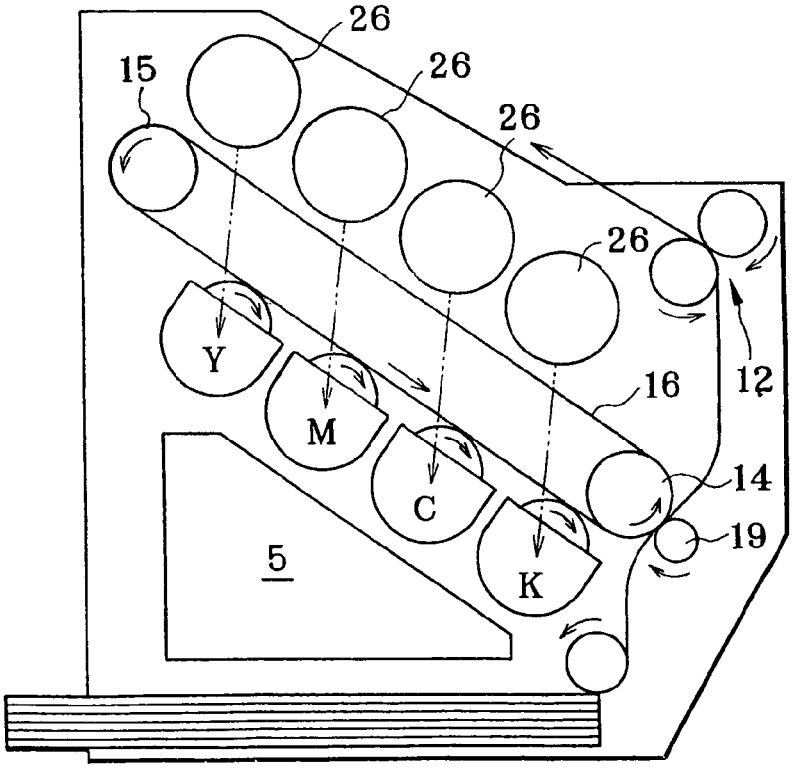
FIG. 15 is a schematic illustration showing another embodiment of the image forming apparatus of the present invention.

FIG. 12 through FIG. 15 are schematic illustrations each showing another embodiment of the image forming apparatus of the present invention. The embodiment of FIG. 12 is an example in which an electrical component box 5 is arranged above the paper carrying belt 59 and image forming stations Y, M, C, K are arranged below the paper carrying belt 59. The embodiment of FIG. 13 is an example in which image forming stations Y, M, C, K are arranged above the paper carrying belt 59 and an electrical component box 5 is arranged below the paper carrying belt 59. The embodiment of FIG. 14 is an example in which image forming stations Y, M, C, K and an electrical component box 5 are arranged above the intermediate transfer belt 16. The embodiment of FIG. 15 is an example in which toner storage containers 26 of image forming stations Y, M, C, K are arranged above the intermediate transfer belt 16 as compared to the embodiment of FIG. 1.

Though the present invention has been described with reference to the embodiments disclosed herein, the present invention is not limited thereto and the components of the present invention may be replaced with or include conventionally known or well known techniques.

For example, though the array-type writing heads are used as the image writing means 23 in the aforementioned embodiments, laser exposure device may be employed. In this case, the electrical component box 5 may be placed on the side of the laser exposure device (the depth side or the front side of FIG. 1).

Further, though the driving roller 14 is located at the lower side and the driven roller 15 is located at the upper side in the embodiment of FIG. 1, the driven roller 15 may be located at the lower side and the driving roller 14 may be located at the upper side.

In addition, though the pivot shafts of the first door member 3 and the frame 9*a* are located at the both sides of the housing body 2 so that they are movable vertically in the above embodiments, the pivot shafts may be located at a lateral side of the housing body 2 so that they may be movable horizontally.

It should be noted that the intermediate transfer belt and the paper carrying belt are generally defined as transfer belt.

What is claimed is:

1. An image forming apparatus, comprising:

image forming stations for respective colors arranged along an intermediate transfer belt, each said image forming station including an image carrier;

a charging means and a developing means disposed around said image carrier;

a housing body in which said image forming stations and said intermediate transfer belt are situated;

a support frame for supporting a driving roller and a driven roller around which said intermediate transfer belt is laid with some tension;

an image density detecting means which is arranged to face said intermediate transfer belt; and a locking means, disposed on the side of said driven roller, for locking said support frame to the housing body;

wherein said support frame is attached to the housing body such that the support frame is detachable relative to the housing body by means of pivotal movement; and wherein said image density detecting means is connected to the support frame, in proximity to said locking means.

2. An image forming apparatus as claimed in claim 1, wherein said transfer belt is a paper carrying belt.

3. An image forming apparatus as claimed in claim 1, wherein said transfer belt is an intermediate transfer belt.

4. An image forming apparatus, comprising:

image forming stations for respective colors arranged along an intermediate transfer belt, each said image forming station including an image carrier;

a charging means and a developing means disposed around said image carrier;

a housing body in which said image forming stations and said intermediate transfer belt are situated;

a support frame for supporting a driving roller and a driven roller around which said intermediate transfer belt is laid with some tension;

an image density detecting means which is arranged to face said intermediate transfer belt;

wherein said support frame is attached to the housing body such that the support frame is detachable relative to the housing body by means of pivotal movement; and wherein said image density detecting means is connected to the support frame, in proximity to said driving rollers which is near the pivot of said support frame.

5. An image forming apparatus as claimed in claim 4, wherein said transfer belt is a paper carrying belt.

6. An image forming apparatus as claimed in claim 4, wherein said transfer belt is an intermediate transfer belt.

* * * * *